United States Patent [19]

Bohnet et al.

[11] 4,397,508

[45] Aug. 9, 1983

[54] BUILT-IN BAKING AND ROASTING OVEN

[76] Inventors: Armin Bohnet, Goetheplatz 5, D-7520 Ludwigsburg; Horst Baschin, Merianstrasse 53, D 7520 Bruchsal, both of Fed. Rep. of Germany

[21] Appl. No.: 232,416

[22] Filed: Feb. 6, 1981

[30] Foreign Application Priority Data

Feb. 7, 1980 [DE] Fed. Rep. of Germany ..... 3004410
Feb. 7, 1980 [DE] Fed. Rep. of Germany ... 8003163[U]

[51] Int. Cl.[3] ..... A47B 51/00

[52] U.S. Cl. ..... 312/312; 312/238; 312/306; 126/37 R

[58] Field of Search ..... 312/312, 306, 238, 239; 126/37 R

[56] References Cited

U.S. PATENT DOCUMENTS

| | | | |
|---|---|---|---|
| 804,957 | 11/1905 | Keller | 312/306 |
| 1,099,521 | 6/1914 | Sprung | 312/312 |
| 1,612,730 | 12/1926 | Keichline | 126/37 R |
| 1,963,281 | 6/1934 | Rogers | 126/37 R |
| 2,244,211 | 6/1941 | Nelson | 312/312 |
| 2,539,613 | 1/1951 | Earle | 126/37 R |
| 2,658,985 | 11/1953 | Maxwell | 126/37 R |
| 2,889,442 | 6/1959 | Schultz | 126/37 R |
| 2,919,340 | 12/1959 | Jacobs | 126/37 R |
| 3,028,209 | 4/1962 | Hinkel et al. | 312/312 |
| 3,358,669 | 12/1967 | Schibley | 126/37 R |
| 3,472,219 | 10/1969 | Roy et al. | 126/37 R |
| 3,650,591 | 3/1972 | Longmire, Sr. | 312/306 |

*Primary Examiner*—Victor N. Sakran
*Attorney, Agent, or Firm*—Spencer & Kaye

[57] ABSTRACT

An installation for a baking and roasting oven in a built-in kitchen composed of cabinet-like modules immediately adjacent one another and covered with tops forming a work surface, which installation includes a wall cabinet housing accommodating the baking and roasting oven and presenting an interior bottom surface, the cabinet being integrated into the built-in kitchen, and a displacement device supporting the wall cabinet housing and arranged to move the housing vertically between a lowered position and a raised position in which the bottom surface is disposed at the level of the portion of the work surface formed by the tops of the modules directly in front of the housing.

4 Claims, 5 Drawing Figures

IV
1
2
3'
4
5
5'
6
7
8
8'
8''
9
10
11
12
13
14
15

1
2
3'
4
5
5'
6
7
8
8'
8''
9
10
11
12
13
14
15

BUILT-IN BAKING AND ROASTING OVEN

BACKGROUND OF THE INVENTION

The present invention relates to a baking and roasting oven for built-in kitchen units with cabinet-like modules which are arranged immediately adjacent one another and are covered with a plate forming a work surface.

In such built-in kitchen units, the baking and roasting oven is often arranged either next to the cabinet-shaped units, and thus is installed underneath the work plate, or is inserted into a recess of a wall cabinet approximately at chest level. In the first-mentioned arrangement for the baking and roasting oven, the user must bend over to insert or remove the containers for the baked goods into or from the cooking chamber while with the accommodation of the baking and roasting oven in the higher situated recess, the user can insert and remove the baked goods containers while standing essentially in an upright position. In both cases, while using the baking oven, the user is hindered by the oven door which is generally articulated below the cooling chamber since in its opened position this door extends horizontally forward from the baking and roasting oven.

Particularly when removing hot baked goods containers, e.g. pans, sheets or baking dishes, containing hot baked goods, there exists the grave danger, if the manipulation is not adept, of incurring burn injuries. Especially older and handicapped persons are exposed to such dangers to a great degree.

SUMMARY OF THE INVENTION

It is an object of the present invention to reduce these drawbacks and difficulties in a built-in baking and roasting oven in a built-in kitchen. A more specific object of the invention is to make the loading and unloading of the baking chamber of such an oven easier and safer.

The above and other objects are achieved, according to the invention, by the provision of an installation for a baking and roasting oven in a built-in kitchen composed of cabinet-like modules immediately adjacent one another and covered with tops forming a work surface, which installation includes a wall cabinet housing accommodating the baking and roasting oven and presenting an interior bottom surface, the cabinet being integrated into the built-in kitchen, and displacement means supporting the wall cabinet housing and arranged to move the housing vertically between a lowered position and a raised position in which the bottom surface is disposed at the level of the portion of the work surface formed by the tops of the modules directly in front of the housing.

The advantages realized by the invention are essentially that loading and unloading of the baking chamber is possible in the plane most comfortable for the user, i.e. at the usual work surface level. Thus the difficult lowering or raising of the baking and roasting containers on the part of the user is eliminated.

DESCRIPTION OF THE PREFERRED EMBODIMENTS

Figure 1:
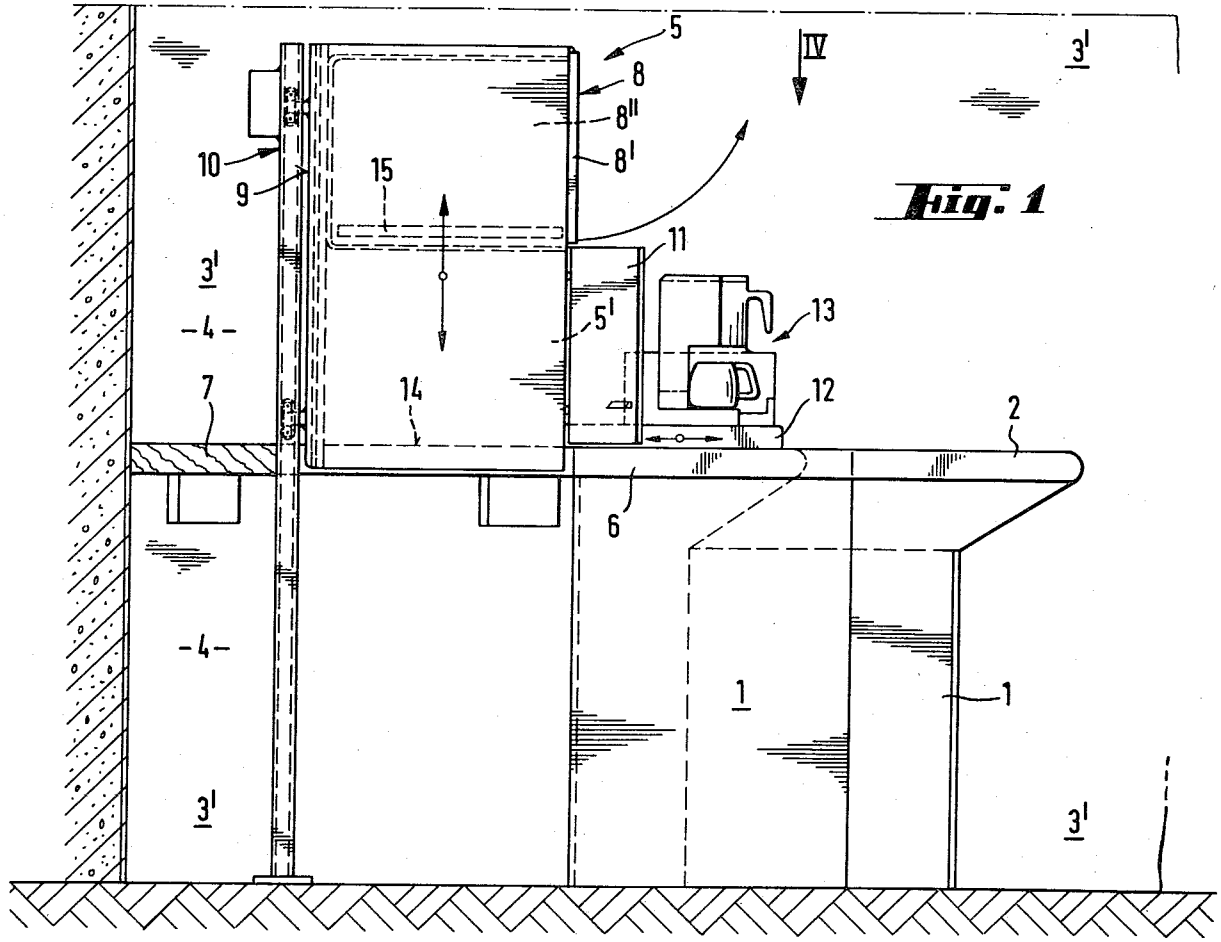
FIG. 1 is a side elevational view of a portion of a built-in kitchen equipped with one preferred embodiment of a baking and roasting oven according to the invention, shown in its raised position.
Figure 2:
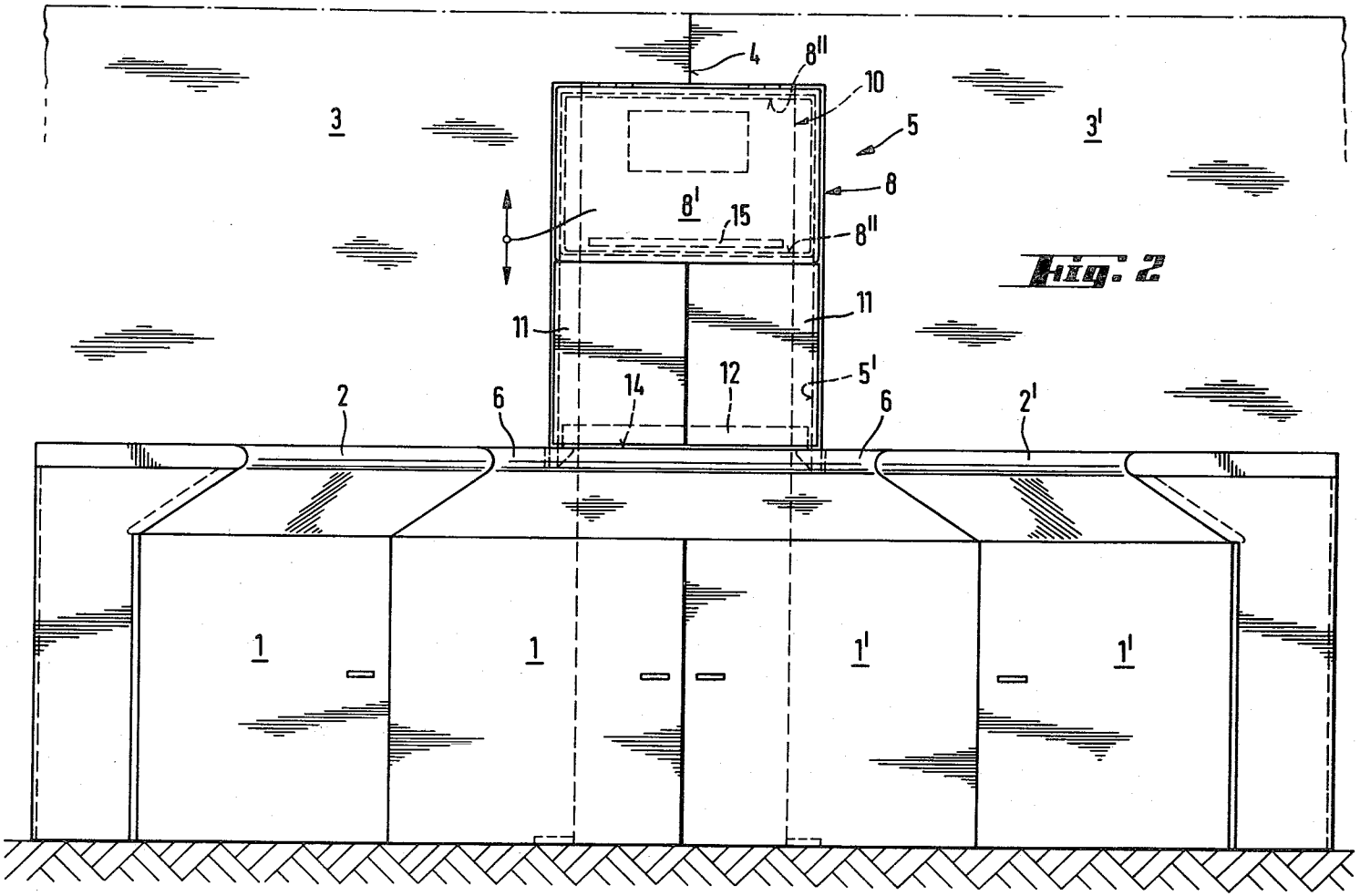
FIG. 2 is a front elevational view of the components shown in FIG. 1.
Figure 3:
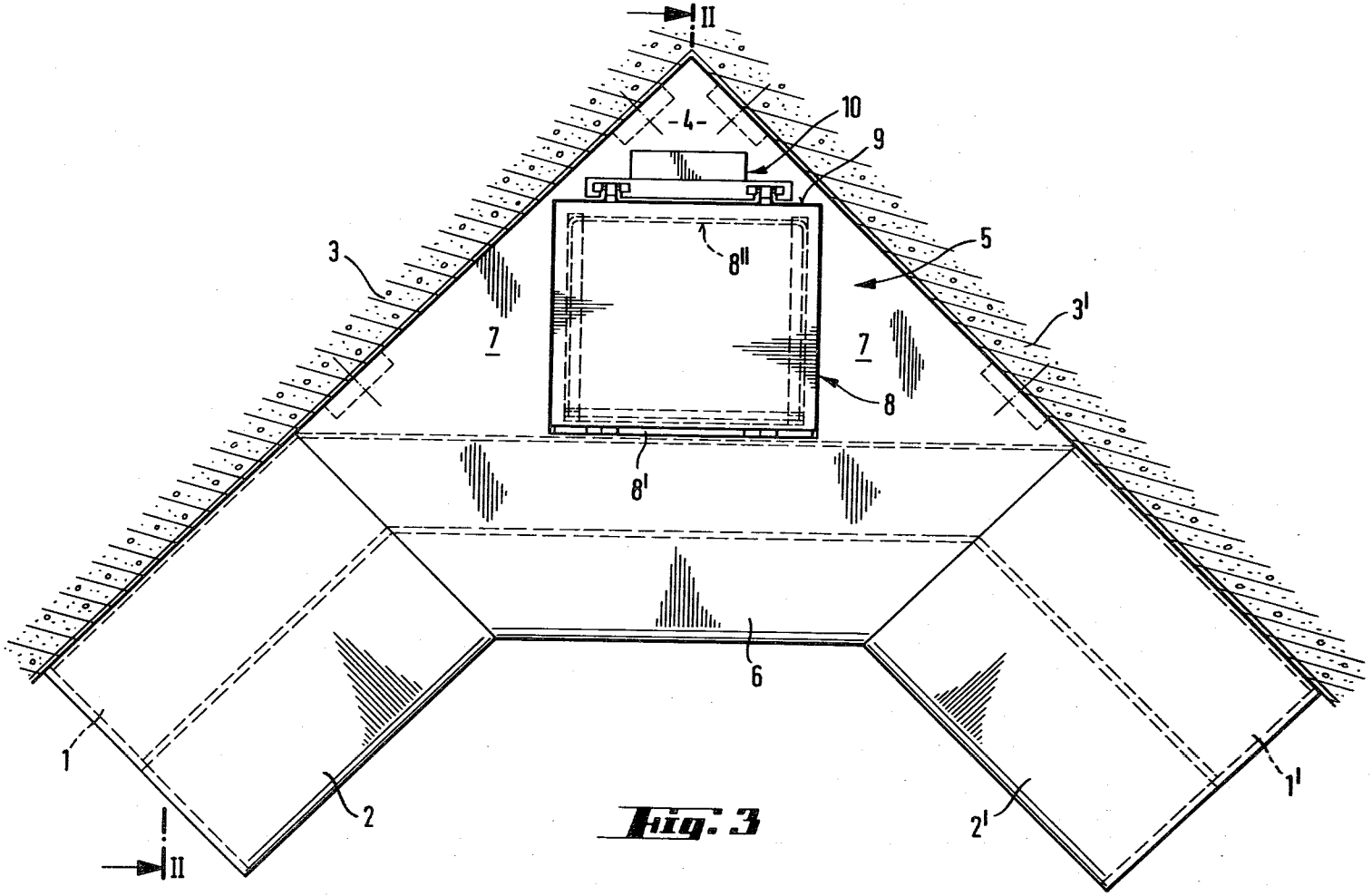
FIG. 3 is a top plan view of the components shown in FIGS. 1 and 2.
Figure 4:
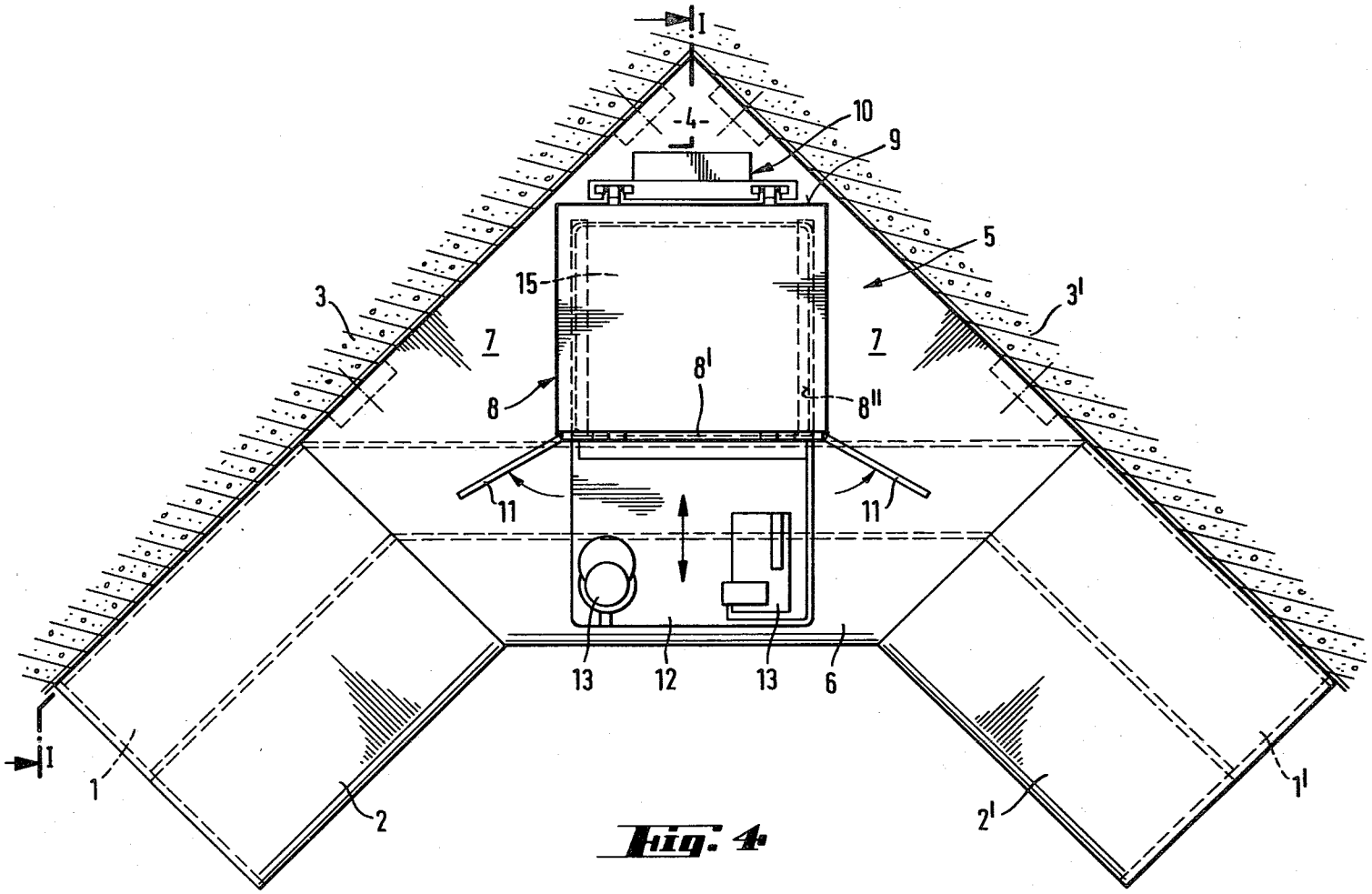
FIG. 4 is a view similar to that of FIG. 3 but with various components in a changed position.

The built-in kitchen portion shown in the Figures includes a plurality of cabinet-like units 1, 1' which rest on the kitchen floor and are aligned one directly next to the other in order to form a closed kitchen furniture front. The outer units are then covered with countertops 2 and 2' which form parts of a common work surface. Normally, cabinets 1, 1' will be dimensioned to allow countertop 2, 2' to be placed at the most convenient work surface height for the users of the kitchen.

In the illustrated, preferred embodiment, the individual units 1 and 1' are arranged at room walls 3, 3' which are at a right angle to one another, i.e. at a corner of the kitchen. The arrangement has been made in such a way that at their rear sides the two units 1, 1' form a so-called dead space 4 in the area where they come together. In this dead space there is provided, as a further module, a wall cabinet housing 5. The two countertops 2 and 2' of the units 1 and 1' are connected together in front of the wall cabinet housing 5 by a coplanar further countertop 6 which constitutes a part of the common work surface in front of the wall cabinet housing 5. At the level of the countertops 2 and 2', the unused parts of the dead space 4, i.e. around the wall cabinet housing 5, are also covered by a countertop 7 coplanar with tops 2, 2' and 5 and forming a further part of the common work surface. Tops 2, 2', 6 and 7 can be made of one or any desired number of pieces.

Inside the wall cabinet housing 5 there is installed a baking and roasting oven 8, and the wall cabinet housing 5 is advantageously mounted via its rear panel 9 to a support and lifting device 10 which is fixed to the kitchen floor. With this lifting device, the wall cabinet housing 5 with the baking and roasting oven 8 disposed therein can be moved up and down. Thus it is possible, in particular, to bring the bottom, or floor, of the cooking chamber 8'' of the baking and roasting oven 8 into a horizontal plane with the countertop 6 disposed in front thereof so that loading and unloading of chamber 8'' can be performed by the user in the plane of the countertop 6.

Underneath the baking and roasting oven 8, the wall cabinet housing 5 further presents a chamber 5' having a floor 14 constructed to carry a carrier plate 12 which can be brought forward onto countertop 6 and which can accommodate small electrical kitchen appliances 13. The chamber 5' is arranged to be closed, so as to be hidden from view, by folding doors 11 which are hinged to the sides of housing 5 and can thus be pivoted between open and closed positions.

In the rest or starting position of housing 5, shown in FIG. 1, the floor 14 of chamber 5' is disposed at the level of the countertop 6 disposed in front thereof. By actuating a control pulse, suitable mechanical displacement means can bring the carrier plate 12 and the small kitchen appliances 13 disposed thereon into the users access range on the countertop 6 while simultaneously the folding doors 11 are pivoted outwardly.

After using the small kitchen appliances, renewed actuation of a control pulse returns the carrier plate 12 into the interior of the chamber 5' in wall cabinet housing 5. The folding doors 11 are then closed, either automatically or manually, and, when in the closed state, can enable control pulses to actuate a drive system to effect lowering of the wall cabinet housing 5 by means of the lifting device 10.

Figure 5:
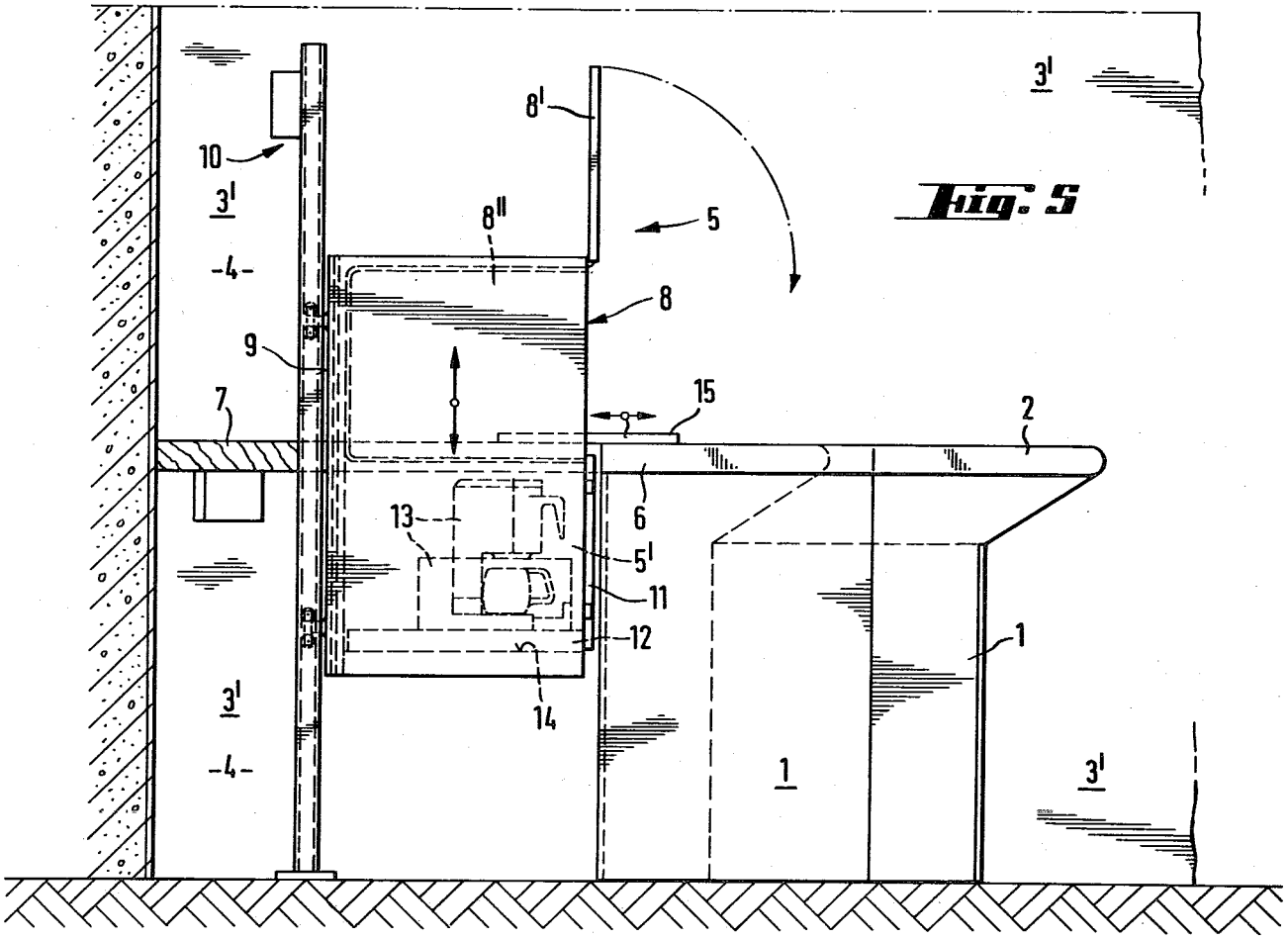
FIG. 5 is a view similar to that of FIG. 1 with the baking and roasting oven lowered to the level of the work surface.

If the baking and roasting oven 8 is then to be used, another control pulse is actuated to lower the wall cabinet housing 5 further, if necessary, to the position as shown in FIG. 5 so that, after opening the oven door 8', a baked and roasted goods carrier 15 carried in the oven is disposed approximately in one plane with the countertop 6. The oven door 8' can then be automatically opened, either by being pivoted upwardly through an angle of 180 degress about the upper edge of the oven opening, or by sliding vertically upwardly. The baked or roasted goods carrier 15 deposited on the countertop 6, which may be a baking sheet, frying pan, roasting grille, oven rack, or the like can then be introduced without effort by sliding along a horizontal plane into the cooking chamber of the baking and roasting oven 8. After closing the oven door 8', the baking and roasting oven 8 can be heated either in this position or in the raised position as shown in FIG. 1.

Vertical movement of housing 5 can be effected by any one of a number of motor-driven mechanisms including rope or chain and pulley systems or threaded rod and spindle units. Control of the motor or motors could equally be effected in a conventional manner by means of appropriate pushbuttons, switches, dials, etc., operating suitable control circuits.

It is to be understood that the above description of the present invention is susceptible to various modifications, changes and adaptations, and the same are intended to be comprehended within the meaning and range of equivalents of the appended claims.

What is claimed is:

1. An installation for a baking and roasting oven in a built-in kitchen composed of cabinet-like modules immediately adjacent one another and covered with tops forming a work surface, said installation comprising:

a wall cabinet housing accomodating said baking and roasting oven and presenting an interior bottom surface, said baking and roasting oven being disposed in said housing at a location above said bottom surface to define, between the bottom of said oven and said bottom surface, a storage chamber for receiving a movable carrier plate for small kitchen appliances, said cabinet being integrated into the built-in kitchen; and displacement means supporting said wall cabinet housing and arranged to move said housing vertically between a lowered position and a raised position in which said bottom surface is disposed at the level of the portion of the work surface formed by the tops of the modules directly in front of said housing.

2. An arrangement as defined in claim 1 wherein said displacement means are actuatable by a control pulse.

3. An arrangement as defined in claim 1 wherein said oven presents in its interior a container supporting surface and in the lowered position of said housing, said container supporting surface is disposed at the level of the portion of the work surface formed by the tops of the modules directly in front of said housing.

4. Built-in baking and roasting oven as defined in claim 1 wherein the modules form a dead space in which said wall cabinet housing is located.

* * * * *